US006977568B1

(12) United States Patent
Rakus et al.

(10) Patent No.: US 6,977,568 B1
(45) Date of Patent: Dec. 20, 2005

(54) BLOW OPEN MOVING CONTACT ASSEMBLY FOR ELECTRIC POWER SWITCHING APPARATUS WITH A VERY HIGH CURRENT INTERRUPTION RATING

(75) Inventors: Paul R. Rakus, Chippewa Township, PA (US); Thomas C. Pendrick, Clinton, PA (US); John J. Shea, Pittsburgh, PA (US); Jeffrey A. Miller, McKees Rocks, PA (US); Glen C. Sisson, Monaca, PA (US); Michael B. Schulman, Pittsburgh, PA (US); Yun-Ko N. Chien, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/035,229

(22) Filed: Jan. 13, 2005

(51) Int. Cl.[7] ..... H01H 83/00
(52) U.S. Cl. ..... 335/16; 218/22
(58) Field of Search ..... 335/16, 147, 195, 335/165–190; 218/22

(56) References Cited

U.S. PATENT DOCUMENTS 5,247,142 A 9/1993 Yonkovitz et al.
5,337,031 A * 8/1994 Castonguay et al. ..... 335/201
5,341,191 A 8/1994 Crookston et al.
5,793,270 A * 8/1998 Beck et al. ..... 335/16
5,912,605 A * 6/1999 Eberts ..... 335/16
5,969,314 A 10/1999 Rakus et al.
5,974,874 A * 11/1999 Saulsberry ..... 73/152.41
6,005,206 A 12/1999 Rakus et al.
6,417,474 B1 7/2002 Rakus et al.
6,570,116 B2 * 5/2003 Maulandi et al. ..... 218/22
6,870,112 B2 * 3/2005 Bresciani et al. ..... 200/244

* cited by examiner

*Primary Examiner*—Lincoln Donovan
(74) *Attorney, Agent, or Firm*—Martin J. Moran

(57) ABSTRACT

A moving contact assembly for a high-current interruption electric power switching apparatus has an inner carrier for the contact fingers that is rigidly held in a withstand position in an outer carrier by a spring biased cam follower pin engaging a cam profile on the inner carrier and configured to positively seat an inner carrier stop against an outer carrier stop on the outer carrier and to rapidly drive the inner carrier to a blow open position in response to a fault. The cam profile has an extended width divided between spaced apart cam profile sections to absorb the high closing and withstand forces. An abutment on the outer carrier resists bowing of the cam follower pin between the cam profile sections. Complementary convex and concave partial cylindrical surfaces on the inner carrier and a gas shield on the moving assembly carrier body maintain an arc gas seal during blow open.

4 Claims, 9 Drawing Sheets

BLOW OPEN MOVING CONTACT ASSEMBLY FOR ELECTRIC POWER SWITCHING APPARATUS WITH A VERY HIGH CURRENT INTERRUPTION RATING

BACKGROUND OF THE INVENTION

1. Field of the Invention

This invention relates to electric power switching apparatus and in particular to blow open moving contact assemblies for such apparatus with very high current interruption ratings.

2. Background Information

Power circuit breakers typically are used as a main breaker in a power distribution system having additional downstream branch circuit breakers. They are also used as transfer switches for switching between alternative power sources, and as network protectors in larger distribution systems. In such systems, the power circuit breaker must have sufficient withstand capability to allow a downstream breaker to respond to a fault in order to minimize the extent of the outage. However, in the instance of a very large fault, such as a fault just downstream of the power breaker, it is desirable to have the power breaker respond promptly to limit the fault current. It is known to provide a power circuit breaker with a blow open contact structure for this current limiting purpose. This blow opening is driven by the electromagnetic repulsion force on the contacts and is very fast, limiting the actual current to less than the available fault current. Using this scheme in a power breaker requires a rugged, but compact, contact assembly with many individual contact fingers for a high continuous capacity and to withstand the higher closing energy and short time ratings compared to molded case circuit breakers. The contact fingers must be capable of opening collectively within the contact carrier assembly without movement of the operating mechanism. The entire contact carrier assembly is opened by the operating mechanism during normal nonfault operation (without the spontaneous contact opening), and also in the instant after the spontaneous opening of a high current interruption. It is desirable that the contact assembly with the blow open moving contact structure can be used in place of a standard power circuit breaker assembly with few changes to the breaker design so that a high interrupting version can be offered in the same product family.

The contact fingers of the spontaneously opening contact moving structure must have some individual motion with springs to apply contact pressure, supported rigidly until the current-induced force threshold is exceeded. The blow open portion of the assembly must have low inertia and be compact for rapid motion from closed to the widest achievable contact gap. When open, the carrier assembly should maintain good dielectric strength across the contact gap and direct the arc produced gases toward the arc chute.

Finally, the contact assembly must accurately control contact location, force and opening threshold and be tolerant of manufacturing variation while being cost-effective to manufacture.

SUMMARY OF THE INVENTION

Aspects of the invention are directed to a moving carrier assembly for an electric power switching apparatus for interrupting very high currents that is rigid and stable enough to maintain a rigid withstand position despite the high electromagnetic forces until the threshold current is reached and then to reliably blow open while maintaining a good gas seal to enhance arc extinguishment and to prevent flashover until the operating mechanism responds. Aspects that contribute to this performance include an arrangement that fixes the withstand position of the carrier components and ensures reliable response to threshold current that produces the spontaneous opening, a rigid cam structure and a mechanism for resisting bowing of the cam follower pin under the high forces developed with the carrier assembly in the closed position, and a configuration that provides an effective arc gas seal when the assembly blows open.

More particularly the invention includes aspects directed to a moving contact assembly for an electric power switching apparatus comprising: a carrier body, carrier legs for supporting the carrier body for pivotal movement between a closed position and an open position, an outer carrier secured to the carrier body and having an outer carrier stop, an inner carrier mounted on the outer carrier for pivotal movement between a withstand position and a blow open position and having a cam profile, an inner carrier stop, a plurality of contact fingers mounted on the inner carrier, a cam follower pin, and cam springs seated against the outer carrier and biasing the cam follower pin against the cam profile. The cam profile is configured so that for current through the contact fingers below a threshold current, the inner carrier is biased to the withstand position which is established by the inner carrier stop engaging the outer carrier stop, and for current through the contact fingers greater than the threshold current the inner carrier is rapidly pivoted to the blow open position.

Additional aspects of the invention are directed to a moving carrier assembly for an electric power switching apparatus comprising: a carrier body, carrier legs supporting the carrier body for movement between the closed position and an open position, an outer carrier secured to the carrier body and having a pair of spaced outer carrier sidewalls with confronting elongated slots and a base section between the outer carrier sidewalls, the base section having a medial abutment surface, an inner carrier mounted in the outer carrier for pivotal movement between a withstand position and a blow open position and having a cam profile with a pair of axially spaced apart cam profile sections, a plurality of contact fingers mounted on the inner carrier, a cam follower pin having ends received in the elongated slots, and cam springs bearing against the outer carrier and biasing the cam follower pin against the axially spaced apart cam profile sections. The cam profile is configured so that with current through the contact fingers below a threshold current the inner carrier is biased to the withstand position, and for current through the contact fingers above the threshold current, the inner carrier is rapidly pivoted to the blow open position. The medial abutment on the outer carrier is positioned to engage the cam follower pin intermediate the spaced apart cam profile sections with the inner carrier in the withstand position to resist bending of the cam follower pin.

Other aspects of the invention are directed to a moving carrier assembly for an electric power switching apparatus comprising: a carrier body, carrier legs supporting the carrier body for pivotal movement between a closed position and an open position, an outer carrier secured to the carrier body, an inner carrier having inner carrier sidewalls mounted on the outer carrier for pivotal movement between a withstand position and a blow open position, an end wall having a cam profile and a cross wall each between the inner carrier sidewalls, contact springs seated on the inner carrier and bearing against the plurality of contact fingers, a cam follower pin, and cam springs seated against the outer carrier biasing the cam follower pin against the cam profile. The cam profile is configured so that for current through the contact fingers below a threshold current the inner carrier is biased to the withstand position and for current through the contact fingers above the threshold current the inner carrier is rapidly driven to the blow open position, and a gas shield associated with the carrier body and having a concave inner surface facing the cross wall. The cross wall has a convex outer wall complimentary and in close proximity to the concave inner surface on the gas seal to maintain a gas shield as the inner carrier pivots from the withstand position to the blow open position.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
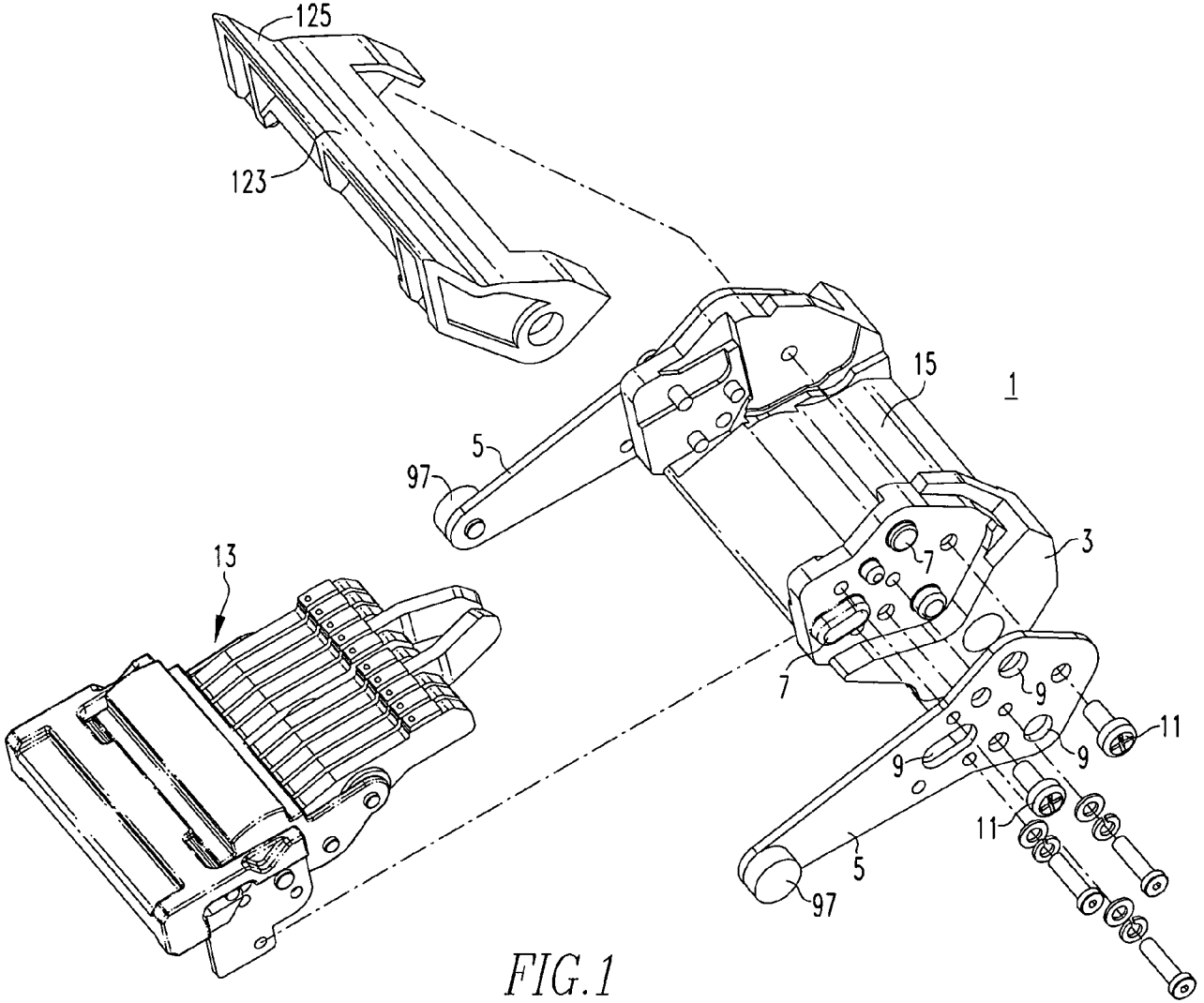
FIG. 1 is an exploded isometric view of a moving contact assembly in accordance with the invention.

Referring to FIGS. 1 through 6, the exemplary embodiment of the moving contact assembly 1 incorporating aspects of the invention includes a carrier body 3 molded of an electrically insulative resin. A pair of carrier legs 5 are locked to the carrier body 3 by a number of molded protrusions 7 that seat in complementary openings 9 in the legs, and are held in place by fasteners 11 so that the connection between the legs and the carrier body is rigid. A sub-assembly 13 is received in a cavity 15 in the carrier body 3.

Figure 2:
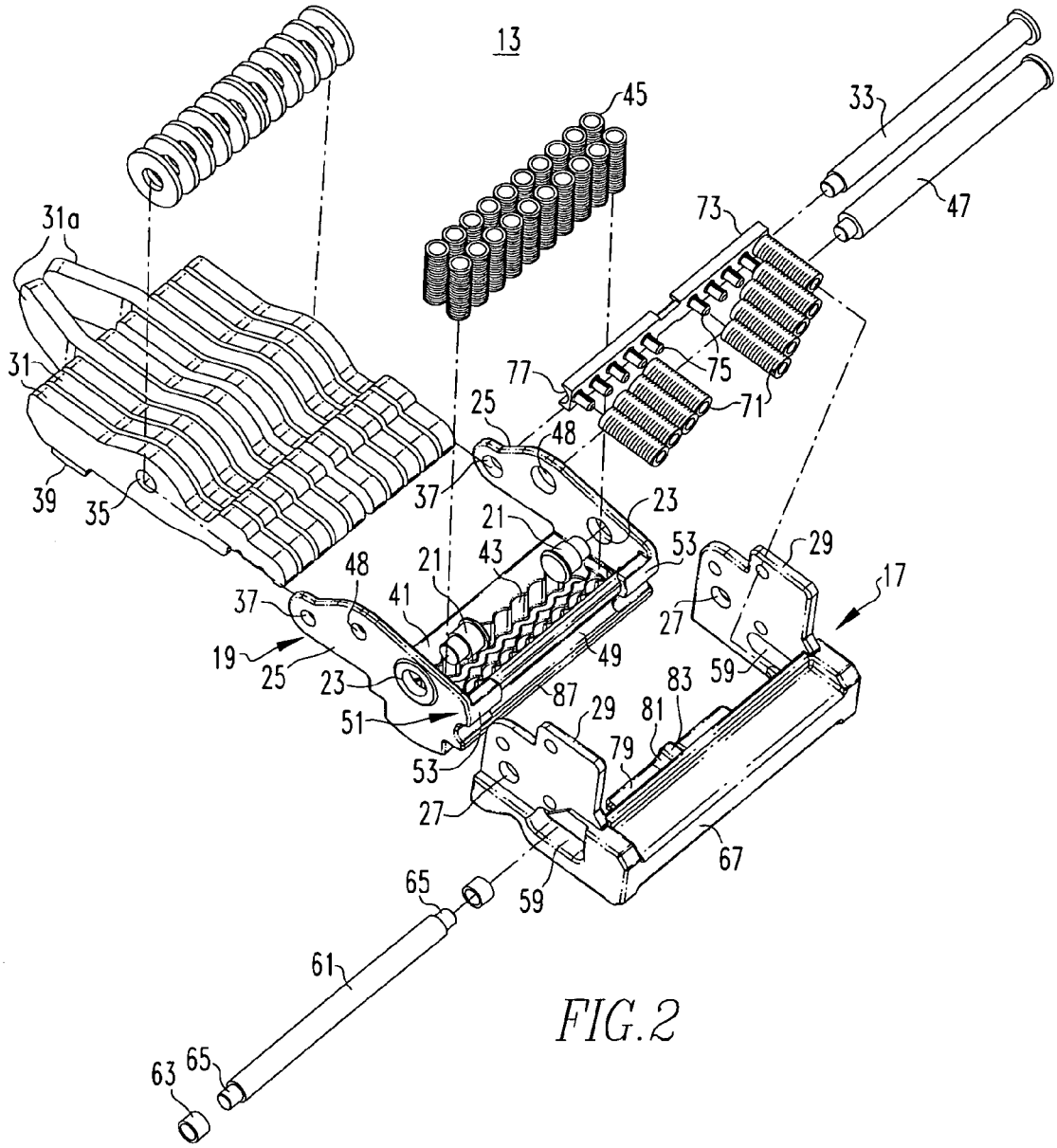
FIG. 2 is an exploded isometric view of pertinent parts of the moving contact assembly of FIG. 1 as viewed from opposite the side shown in FIG. 1.

The sub-assembly 13, which is shown exploded in FIG. 2, includes an outer carrier 17 that is firmly secured in the carrier body 3. An inner carrier 19 is pivotally mounted to the outer carrier 17 by pivot pins 21 that pass through holes 23 in inner carrier sidewalls 25 and seat in holes 27 in outer carrier sidewalls 29. A plurality of contact fingers 31 are pivotally mounted on the inner carrier sidewalls 25 by a contact finger pin 33 that passes through holes 35 in the contact fingers 31 and engage holes 37 in the inner carrier sidewalls 25. Two of the contact fingers 31*a* extend beyond the other contact fingers and bend inward to form arc fingers that, as will be seen, direct arcs formed during current interruption into an arc chute of the circuit breaker. Moving contacts 39 are affixed to each of the contact fingers 31.

Figure 4:
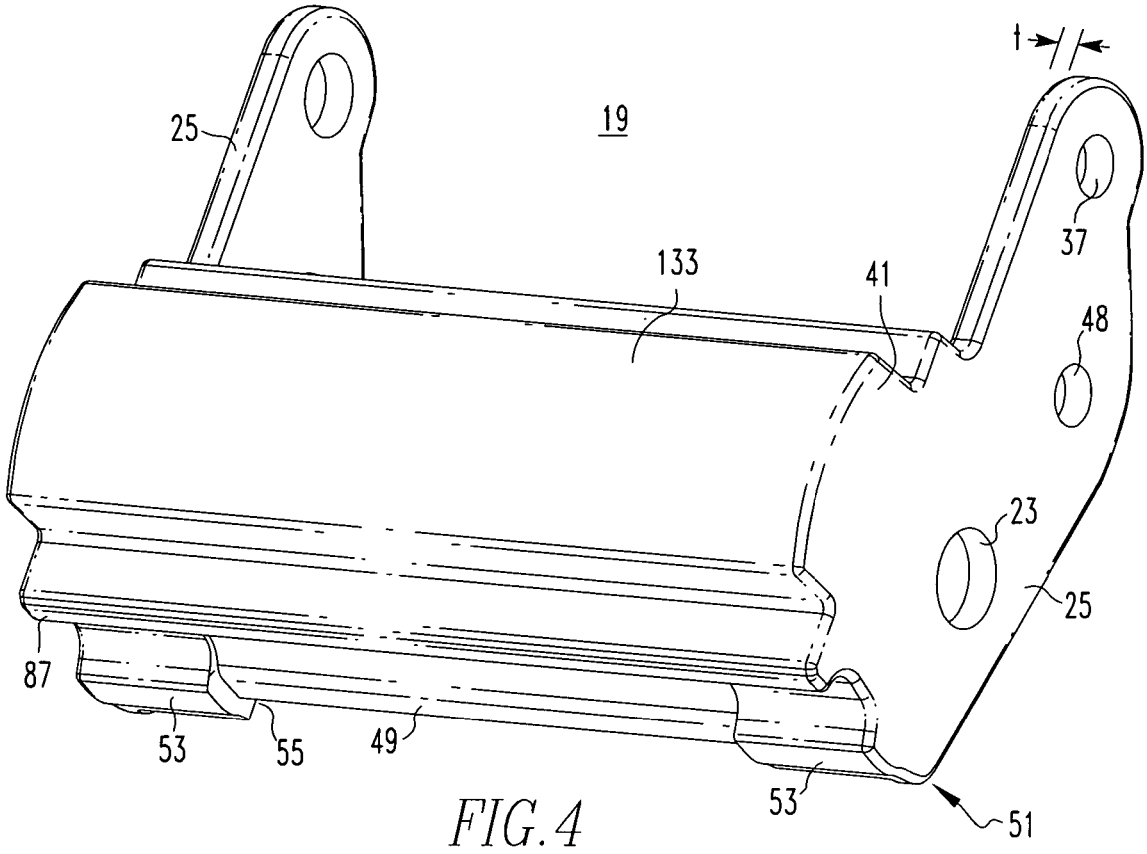
FIG. 4 is an isometric view of the inner carrier of the moving contact assembly showing the opposite side from that shown in FIG. 2.

As can be seen best in FIGS. 2 and 4, the inner carrier 19 has a cross wall 41 extending between the inner carrier sidewalls 25. This cross wall 41 has two rows of contact spring pockets 43 on an inner surface in which are seated contact springs 45 that bias the contact fingers 31 against a contact finger stop pin 47 extending between holes 48 the inner carrier side walls 25. The contact springs 45 provide contact pressure and adjustment for contact wear as is well known.

The inner carrier 19 also has an end wall 49 extending between the inner carrier side walls 25. This end wall 49 can be integral with or separate from the cross wall 41. On the end wall 49 is a cam profile 51 which is made up of two spaced apart cam profile sections 53 at the ends of the end wall 49. This leaves a recess 55 in the end wall between the cam profile sections 53. It will be noted from FIG. 4 that the cam profile sections 53 extend axially along the end wall 49 a greater distance than the thickness, t, of the inner carrier sidewalls 25.

Figure 3:
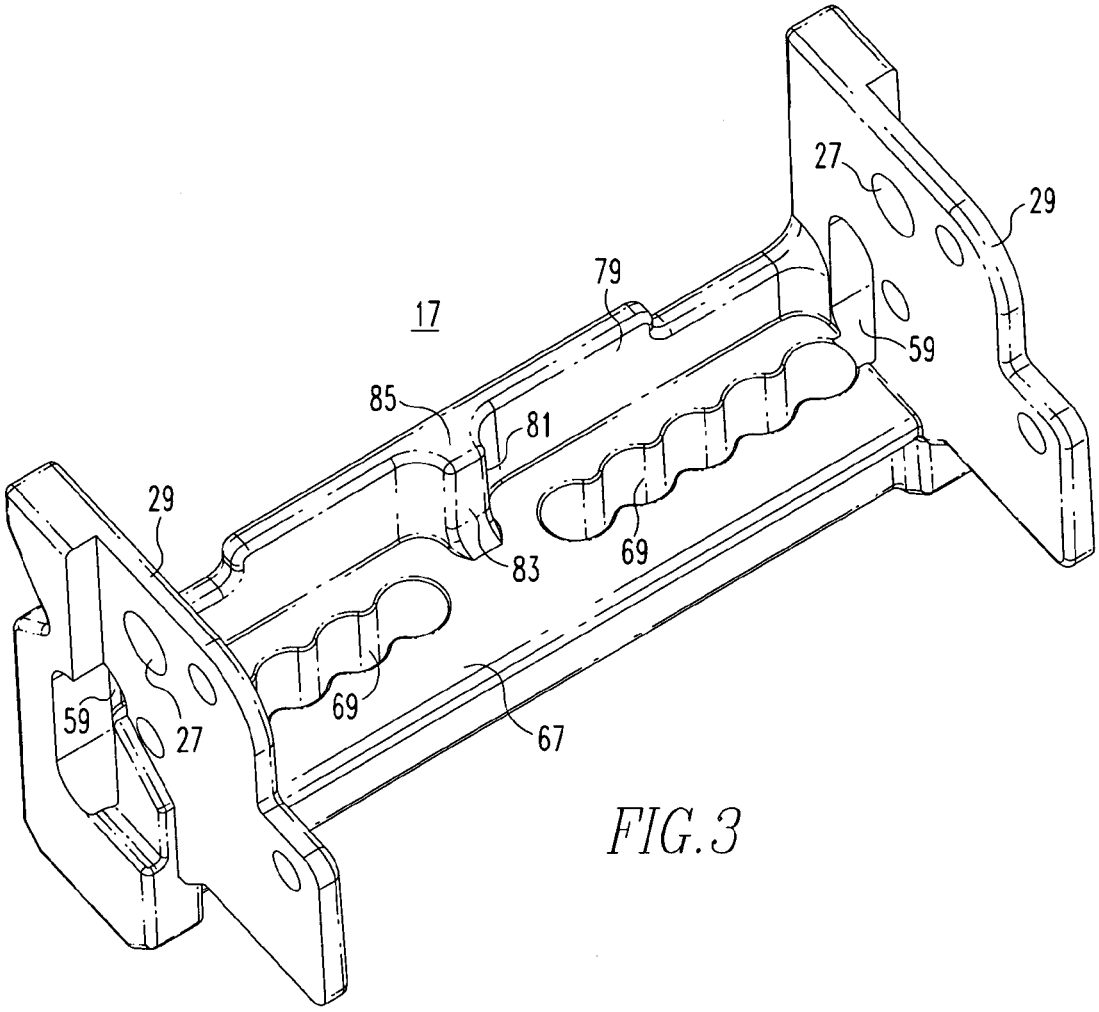
FIG. 3 is an isometric view of the outer carrier of the moving contact assembly rotated to show interior features.

The outer carrier 17, as best viewed in FIGS. 2 and 3, has a pair of confronting elongated slots 59 in the outer carrier sidewalls 29. A cam follower pin 61 that may have bushings 63 on the ends 65 slides in the elongated slots 59. The outer carrier 17 has a base section 67 extending between the outer carrier sidewalls 29 that has a row of cam spring pockets 69 in which are seated a number of cam springs 71. A cam spring holder 73, see FIGS. 2 and 6, has a number of posts 75 on which the opposite ends of the cam springs 71 seat. Opposite the posts 75 is a partial cylindrical surface 77 that bears against the cam follower pin 61. A flange 79 on the base section 67 has a medial rib 81 that has a surface 83 forming a medial abutment while the end of the central rib 81 forms an outer carrier stop 85. The end wall 49 on the inner carrier 19 forms an inner carrier stop 87 adjacent the cam sections profile 53, that as will be seen engages the outer carrier stop 85 to accurately fix the withstand position of the inner carrier 19.

Figure 5:
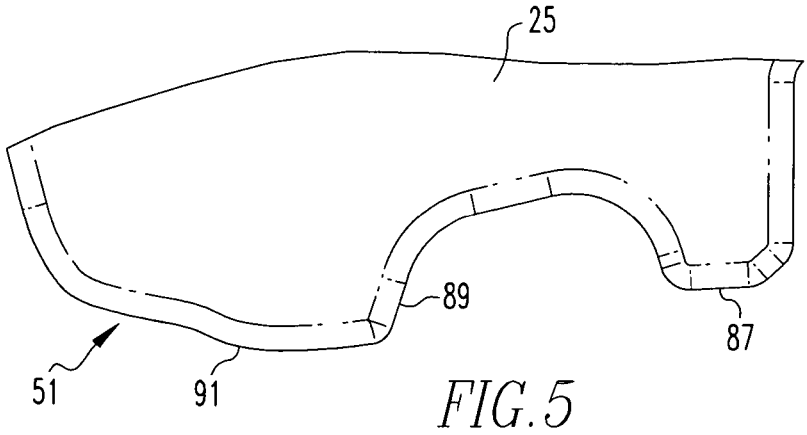
FIG. 5 is a fractional enlarged view showing the cam profile on the inner carrier.

The blow open action of the breaker is created by the cam profile 51 (through the cam sections 53) and the cam follower pin 61 guided by the elongated slots 59 in the outer carrier sidewalls 29. The cam follower pin 61 is pressed against cam follower profile sections 53 by the cam springs 71. The cam spring holder 73, fit securely to the spring ends by the posts 75, creates a stable seat for the cam springs 71 against the cam follower pin 61. A plurality of small springs 71 is used to achieve a compact package and to allow the cam-off force of the assembly to be adjusted by leaving a variable number of spring locations vacant. The cam profile 51 is designed to hold the inner carrier 19 stiffly in place in the withstand position shown in FIG. 6 up to the peak force generated by a selected threshold current through the contact fingers 31 and then to rotate abruptly to the blow-open position shown in FIG. 6A. As best seen in FIG. 5, the steeply-rising portion of the cam profile 51 that creates the high withstand force may include a withstand segment 89 of constant slope (radius rise relative to angular position) to accommodate manufacturing variation without substantial change in peak force. After the peak force in the opening direction, the cam profile 51 falls gently to a lower radius at the open end of travel 91. This portion is a rising radius when the inner carrier 19 is resetting and is optimized to minimize dynamic rebound of the inner carrier 19 (and possible re-ignition of an arc) during high current interruption, but allow resetting when the operating mechanism trips as will be discussed. When the inner carrier 19 is under the peak force before blow-off, the cam follower pin 61 is bearing against the edges of the elongated slots 59 in the outer carrier sidewalls 29. Friction is reduced by the rolling bushings 63 on the ends 65 of the cam follower pin 61.

Figure 6:
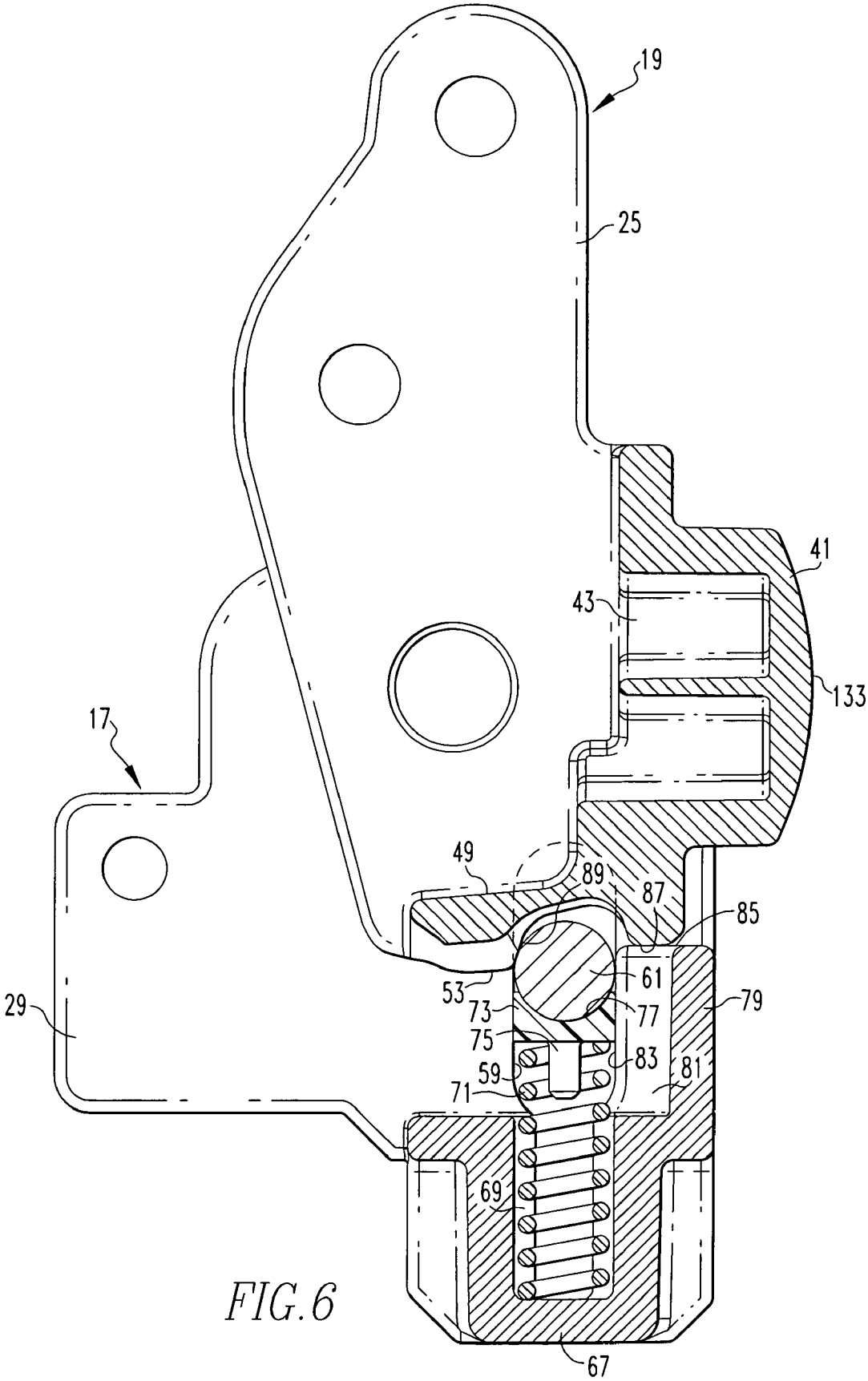
FIG. 6 is an enlarged sectional view through the inner and outer carriers with the inner carrier in the withstand position.
Figure 6A:
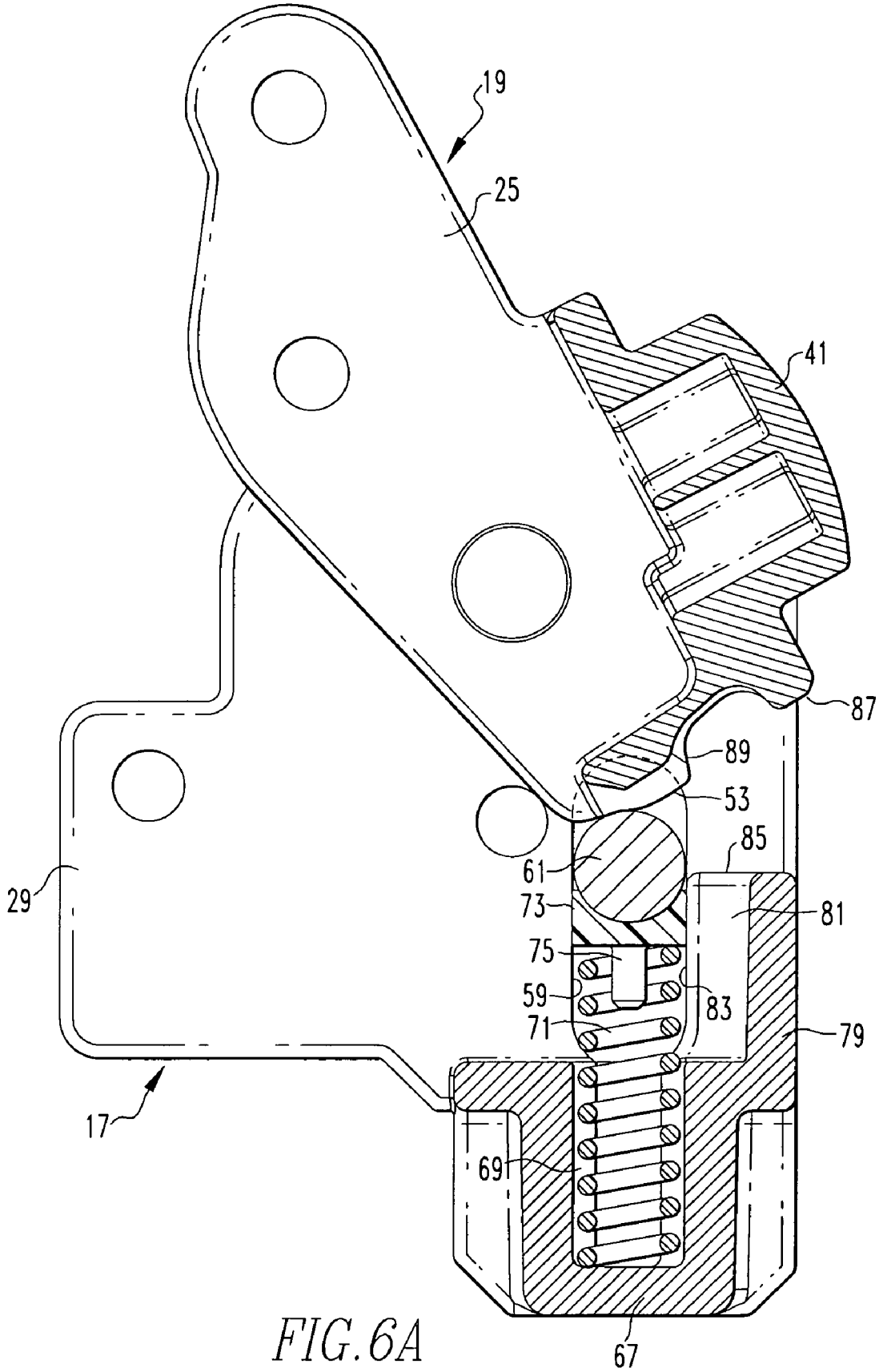
FIG. 6A is similar to FIG. 6 but showing the inner carrier in the blow open position.

The one-piece inner and outer carriers 19, 17 with integral spring pockets 43, 69 increase overall strength and reduce the number of parts, assembly costs and manufacturing variation in the moving contact assembly 1. The carriers 17, 19 can be cast, metal-injection molded, or otherwise produced from various magnetic or non-magnetic grades of stainless steel, and hardened as required. The one-piece carriers 17, 19 also provide the design flexibility to reinforce areas like the cam profile sections 53 and the outer carrier side walls 29 at the elongated slots 59 with extra width where needed. The width of the cam profile sections 53 can be selected with the remainder of the width relieved by the recess 55 for clearance with the cam follower pin 61. The selective cam profile section width allows reduction of the contact stress, optimization of manufacturing methods and other desired characteristics of the cam function. It also resists the tendency of a bowing cam pin 61 to "walk out" of a full-length cam profile or out of a cam with excess straightness error relative to its width. To minimize the natural bending of the cam follower pin 61, one or more intermediate bearing ribs such as the rib 81 on the outer carrier 17 can be located with the medial abutment surface 83 in line with the edges with the elongated slots 59 at any location across the outer carrier 17. The end of this central rib 81 forms the outer carrier stop 85 against which the inner carrier stop 87 is biased as shown in FIG. 6 to fix the withstand position of the inner carrier 19 with accuracy.

Figure 7:
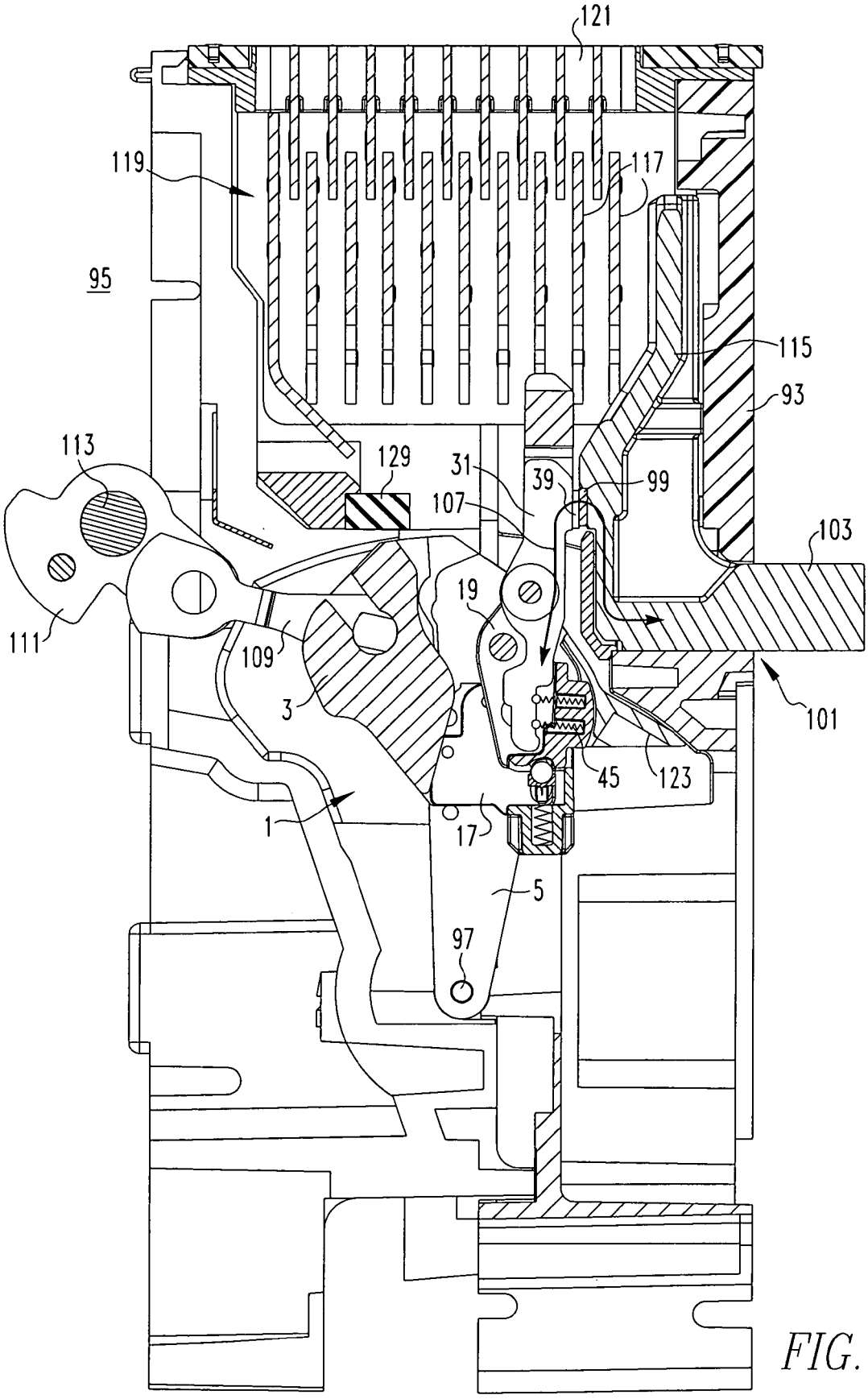
FIG. 7 is a vertical section through the pertinent portion of one pole of a current limiting power circuit breaker incorporating the moving contact assembly of FIGS. 1 through 6 shown in the closed position.
Figure 8:
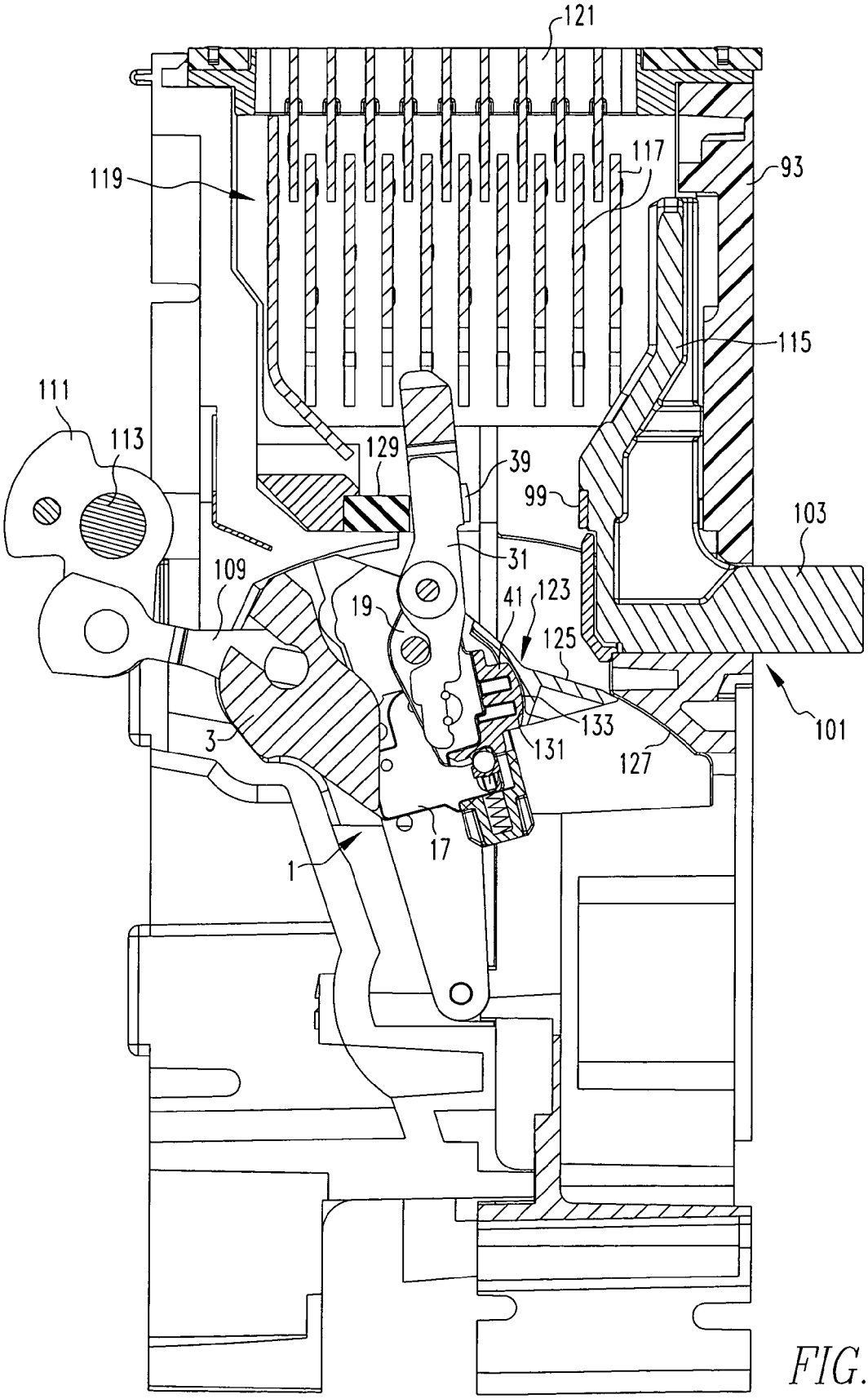
FIG. 8 is similar to FIG. 7 but showing the current limiting power circuit breaker in the open position.
Figure 9:
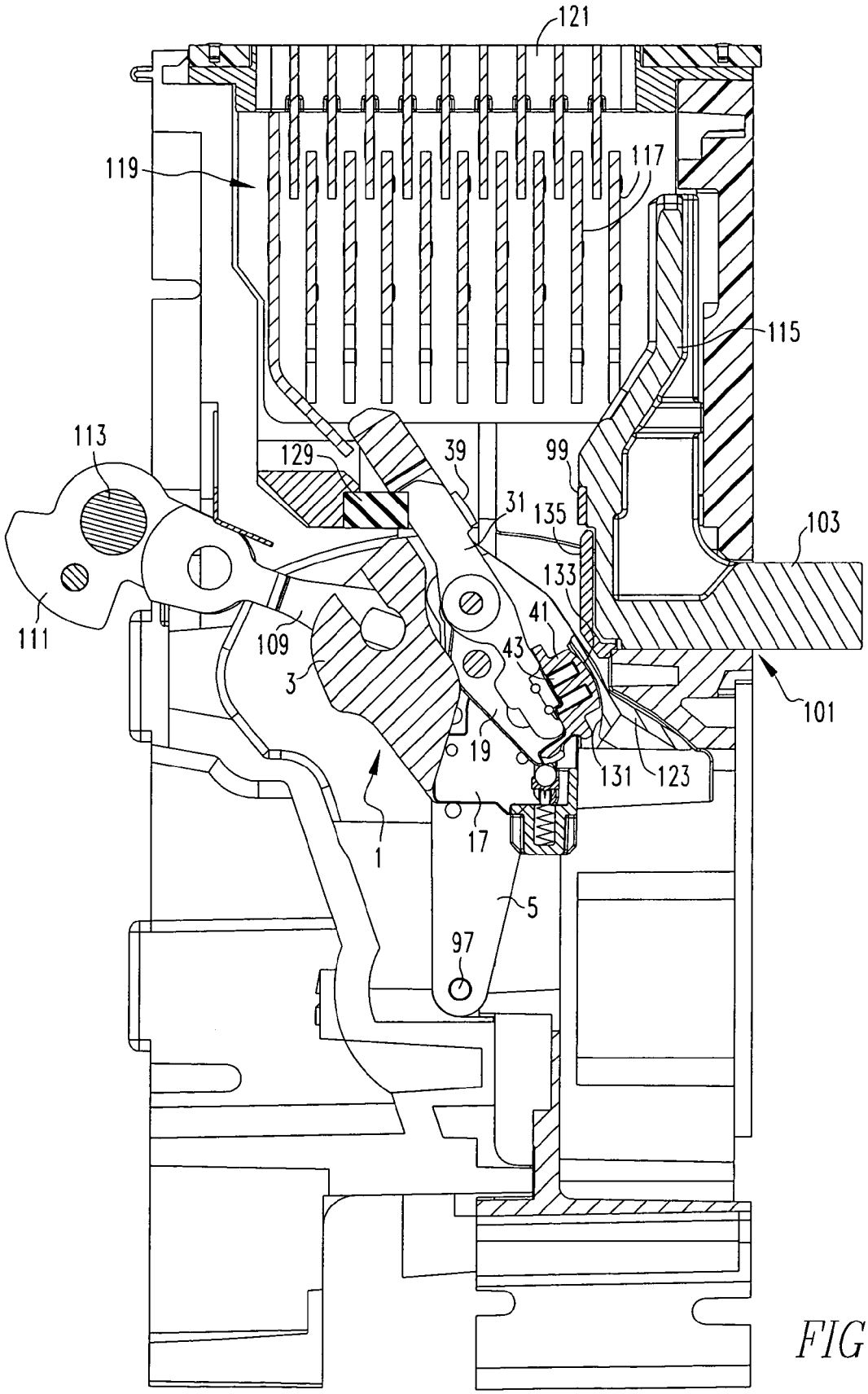
FIG. 9 is similar to FIGS. 7 and 8 but showing the current limiting power circuit breaker in the blow open position.

As can be seen in FIGS. 7 through 9, the moving contact assembly 1 is pivotally mounted in the housing 93 of a power circuit breaker 95 for rotation about bosses 97 on legs 5 between a closed position shown in FIG. 7 and an open position shown in FIG. 8. In the closed position of FIG. 7, the inner carrier 19 is in the withstand position with regard to the outer carrier 17 as seen more clearly in FIG. 6. The moving contacts 39 on the contact fingers 31 are pressed by the contact springs 45 against fixed contacts 99 on the monolithic stationary conductor 101, which has a terminal section 103 forming the line terminal of the power circuit breaker 95. The lower ends of the contact fingers 31 are connected by flexible shunts, not shown for clarity, that are connected to a load terminal (not shown) located below the line terminal 103. With the power circuit thus completed through the circuit breaker 95 current flows in the directions of the arrows 107.

The moving contact assembly 1 is connected through a drive link 109 and crank 111 to a pole shaft 113 connecting the moving contact assembly 1 of each of the poles of circuit breaker 95 to an operating mechanism (not shown). Rotation of the pole shaft 113 in a clockwise direction, either manually or through an operation of a trip unit (not shown) in response to selected amplitude/time characteristics of current, causes the moving contact assembly 1 to be rotated to the open position shown in FIG. 2. As the moving contacts 39 and fixed contacts 99 separate, an arc is struck, which due to electromagnetic forces is driven up the arc runner section 115 of the monolithic stationary contact 101 and into arc plates 117 of an arc chute 119 where the arc is cooled and extinguished in a known manner. Arc gasses generated through vaporization of contact material and gas evolving materials expand up into the arc chute 119 and are exhausted through a vent 121 in the top of housing 93. In order to prevent these arc gasses from expanding downward to the load terminal, the carrier body 3 has an associated gas shield 123 which can be molded as part of the carrier body 3 or can be attached thereto. This gas shield 123 has an outer arcuate surface 125 that is complementary and slides relative to an arcuate surface 127 on the housing 93, as best seen in FIG. 8. Thus, the gas shield 123 blocks the passage of arc gasses downward for all positions of the moving contact assembly 1.

Returning to FIG. 7, it will be seen that the current path represented by the arrows 107 forms a reverse current loop. As is known, such a reverse current loop generates very high electromagnetic forces at fault current levels. When this current reaches a threshold level, the forces generated are sufficient to overcome the bias force applied by the cam springs 71 through the cam follower pin 61 to the cam profile sections 53 and the inner carrier 19 is rapidly rotated ("blown open") to the blow open position shown in FIG. 9. This occurs before the operating mechanism has time to respond to the fault current so as can be seen in FIG. 9, the carrier body 3 remains in the closed position. An elastomeric bumper 129 decelerates the rapidly moving contact fingers 31 and prevents them from rebounding to the withstand position. It will be noticed in FIG. 9 that the gas shield 123 also has a concave partial cylindrical interior surface 131 and that the cross wall 41 on the outer carrier 19, which incorporates the contact spring pockets 43 has an outer convex partial cylindrical surface 133 that is complementary to and in close proximity to the concave surface 131. This arrangement maintains the seal formed by the gas shield 123 even as the inner carrier 19 rotates from the withstand to the blow open position. At the same time, the gas shield 123 is also electrically insulative and along with the insulative member 135 on the front face of the monolithic stationary conductor 101 prevents flashover between the moving contact assembly 1 and the stationary conductor as the inner carrier 19 rotates to the blow open position.

When the operating mechanism (not shown) responds to the fault current, the pole shaft 113 is rotated to rotate the moving contact assembly 1 to the open position shown in FIG. 8. The contact fingers 31 then pivot about the bumper 129 until the inner carrier 19 resets with the cam follower pin 61 engaging the constant sloped portion 89 of the cam profile 51.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A moving contact assembly for electric power switching apparatus comprising:

a carrier body;

carrier legs supporting the carrier body for pivotal movement between a closed position and an open position;

an outer carrier secured to the carrier body and having an outer carrier stop;

an inner carrier mounted in the outer carrier for pivotal movement between a withstand position and a blow open position and having a cam profile and an inner carrier stop;

a plurality of contact fingers mounted on the inner carrier;

a cam follower pin; and cam springs seated against the outer carrier biasing the cam follower pin against the cam profile, the cam profile being configured so that for current through the plurality of contact fingers less than a threshold current the inner carrier is biased to the withstand position which is established by the inner carrier stop engaging the outer carrier stop, and for current through the plurality of contact fingers greater than the threshold current, the inner carrier rapidly pivots to the blow open position.

2. The moving contact assembly of claim 1 wherein the cam profile has a withstand section engaged by the cam follower pin with the inner carrier in the withstand position, the withstand section of the cam profile having a slope that is constant.

3. The moving carrier assembly of claim 1 wherein the outer carrier has outer carrier sidewalls and an outer carrier base section between the outer carrier sidewalls and wherein the outer carrier stop is on the outer carrier base section and wherein the inner carrier has inner carrier sidewalls and an inner carrier end wall, the inner carrier stop being on the inner carrier end wall.

4. The moving carrier assembly of claim 3 wherein the outer carrier base section has cam spring pockets in which the cam springs are seated.

* * * * *